US012410963B2

(12) United States Patent
Gensse et al.

(10) Patent No.: US 12,410,963 B2
(45) Date of Patent: Sep. 9, 2025

(54) CRYOGENIC TUNNEL WITH CONVEYOR FOR PRODUCING CAPSULES OF FOOD PRODUCTS, IN PARTICULAR OF SAUCE

(71) Applicant: L'Air Liquide, Societe Anonyme pour l'Etude et l'Exploitation des Procedes Georges Claude, Paris (FR)

(72) Inventors: Helene Gensse, Villers-sur-Fere (FR); Franck Cousin, Lesquin (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 81 days.

(21) Appl. No.: 18/198,198

(22) Filed: May 16, 2023

(65) Prior Publication Data

US 2023/0375248 A1 Nov. 23, 2023

(30) Foreign Application Priority Data

May 17, 2022 (FR) ..... 2204662

(51) Int. Cl.
*F25D 3/11* (2006.01)

(52) U.S. Cl.
CPC ..... *F25D 3/11* (2013.01)

(58) Field of Classification Search
CPC ..... F25D 3/11; F25D 25/04
USPC ..... 62/380
See application file for complete search history.

(56) References Cited

U.S. PATENT DOCUMENTS 3,361,418 A * 1/1968 Fromont ..... F25D 25/04 432/75
3,685,313 A 8/1972 Rhodes
6,408,639 B1 * 6/2002 Jagaeus ..... F25D 25/04 62/380
8,904,816 B2 * 12/2014 Bergqvist ..... F25C 1/10 62/380

(Continued)

FOREIGN PATENT DOCUMENTS

EP 1 115 637 7/2001
JP S52 109279 A 9/1977

(Continued)

OTHER PUBLICATIONS

European Search Report for corresponding EP 23172622, Sep. 25, 2023.

*Primary Examiner* — Steve S Tanenbaum
(74) *Attorney, Agent, or Firm* — Yan Jiang

(57) ABSTRACT

Equipment for manufacturing pellets of liquid or pasty products, comprising a tunnel and comprising a conveyor belt capable of transporting the product to be processed in the equipment along a processing path that passes through the various zones of the equipment, wherein the conveyor belt is equipped with unitary moulds, or else unitary moulds are formed in the structure of the conveyor belt, wherein the equipment comprises a pellet demoulding zone situated at the outlet of the tunnel or immediately downstream of the outlet of the tunnel, the demoulding zone operating in a rotation zone of the conveyor, and wherein the structure of the belt allows each pellet to be automatically demoulded by ejection, the ejection being effected by a given element of the structure of the conveyor belt on account of opposing forces being applied to the walls of the mould in the demoulding zone.

3 Claims, 2 Drawing Sheets

(56) References Cited

U.S. PATENT DOCUMENTS

| | | | | |
|---|---|---|---|---|
| 2009/0120107 | A1 | 5/2009 | Oztas et al. | |
| 2013/0084373 | A1 | 4/2013 | Linck et al. | |
| 2014/0072688 | A1* | 3/2014 | Strand | A23L 23/00 426/531 |
| 2017/0127706 | A1* | 5/2017 | Folkesson | A23P 30/10 |
| 2019/0323755 | A1* | 10/2019 | Goldstein | A23B 4/062 |

FOREIGN PATENT DOCUMENTS

| | | | |
|---|---|---|---|
| JP | S58 60608 | A | 4/1983 |
| JP | H10 194422 | A | 7/1998 |
| WO | WO 2006/092535 | | 9/2006 |

* cited by examiner

CRYOGENIC TUNNEL WITH CONVEYOR FOR PRODUCING CAPSULES OF FOOD PRODUCTS, IN PARTICULAR OF SAUCE

CROSS-REFERENCE TO RELATED APPLICATIONS

This application claims the benefit of priority under 35 U.S.C. § 119 (a) and (b) to French patent application No. FR 2204662, filed May 17, 2022, the entire contents of which are incorporated herein by reference.

FIELD OF THE INVENTION

The present invention relates to the field of methods and installations for the cryogenic processing of products, in particular food products, and especially methods and installations for manufacturing "ice cubes" or "pellets" (reference is often made to pellets or ice cubes or doses or even capsules) of liquid or pasty products. This category includes, for example, ice cubes made of sauce, puree, juice or other liquids.

BACKGROUND

Recent years have seen the emergence of methods implementing, in order to produce such ice cubes, tunnels with indented belts, which are therefore made up of an articulated chain of small moulds that are filled with the liquid or pasty mixture to be frozen, and the demoulding of which makes it possible to obtain ice cubes with the desired shape and characteristics.

Document EP 1 115 637 on behalf of AGA AB falls within this category of methods and indented belts.

One of the well-known problems with these manufacturing methods is the adhesion of the pellets to the belt or support used and therefore demoulding difficulties, which give rise to material losses or else to surface-marking phenomena of the pellets.

The abovementioned document EP 1 115 637 proposes, for its part, a particular indented belt structure facilitating demoulding and limiting material losses: it proposes precooling the belt through immersion in a bath of cryogenic liquid, before pouring the liquid to be processed into the indentations, which allowed the authors to achieve a crust on the outer surfaces of the pellets. The products are then demoulded and transferred to a more conventional deep-freezer to finish off the complete deep-freezing of the pellets.

The Applicant has proposed, for its part, in document WO 2006/092535, improved equipment for manufacturing such ice cubes of liquid or pasty products, comprising an indented conveyor belt capable of transporting the product to be processed in the equipment along a processing path that passes through the various zones of the equipment, and implementing the following measures:

the equipment successively comprises at least the following three zones:

1. an upstream zone comprising a device for metering and depositing the product to be processed into the indentations in the belt;
2. a cooling zone;
3. a demoulding zone.

The conveyor belt is a bottomless indented belt;

and, in said upstream zone, the belt is situated facing a cooled surface that acts as a base for the partial mould formed by the indentations.

However, the Applicant has recently deemed it necessary to improve upon the previous solution, in particular regarding the throughput of product that can be processed using such equipment, and has deemed it necessary to improve the throughput.

SUMMARY OF THE INVENTION

One of the aims of the present invention is therefore to propose a novel method and equipment for manufacturing frozen ice cubes or pellets that make it possible not only to solve the problems in terms of adhesion and material loss, but also to propose a solution with a greater capacity.

As will be discussed in more detail below, the system for manufacturing ice cubes of liquid or pasty products according to the invention is characterized by the implementation of a novel tunnel structure with a conveyor belt, the belt being equipped with unitary moulds, or such unitary moulds being formed in the conveying structure thereof, wherein each pellet is automatically demoulded by ejection, the ejection being effected by a given element of the structure of the conveyor belt.

BRIEF DESCRIPTION OF THE FIGURES

For a further understanding of the nature and objects of the present invention, reference should be made to the following detailed description, taken in conjunction with the accompanying drawings, in which like elements are given the same or analogous reference numbers and wherein.

DETAILED DESCRIPTION OF THE INVENTION

Figure 1A:
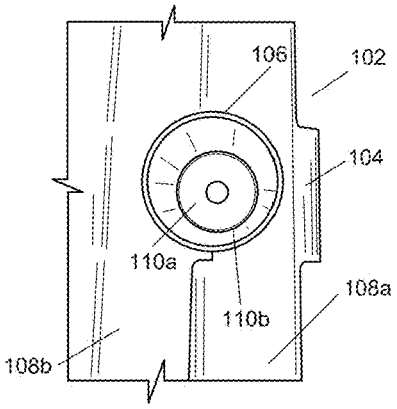
FIG. 1A illustrates one embodiment of a conveyor belt in accordance with the invention showing a location upstream of the demoulding zone.

Appended [FIG. 1A] illustrates one embodiment of a conveyor belt in accordance with the invention, wherein a tunnel 102 with a conveyor belt 104 equipped with unitary moulds 106 with automatic demoulding by ejection is used: this belt 104 is a stainless-steel belt of the type known as a "chain-plate" belt, which is equipped with unitary receptacles (or moulds) 106 that are ready to receive the liquid or pasty mixture, and the demoulding takes place when the conveyor rotates at the outlet in what is referred to as a "demoulding" zone.

and, indeed, these receptacles 106, which are secured to the conveyor, are, for this embodiment, in this case made up of two parts, each receptacle being positioned at the join between two chain plates, the first chain plate 108*a* and the second chain plate 108*b* of the conveyor: one element 110*a* forming the "base of the receptacle" is secured to one chain plate, whereas the other part of the receptacle 110*b*, which may be described as the "sides of the mould", is secured to the chain plate immediately adjoining the first chain plate 108*a*.

thus, at the end of the conveying, the two parts 110*a* and 110*b* of the mould (receptacle) 106 are not subject to the same mechanical stresses, since in this instance, the base of the receptacle pivots 110*a* inside the mould 106 while the walls 110*b* of the mould 106 remain in place, which allows the deep-frozen product to be detached both from the walls 110*b* of the mould 106 and from the base 110*a*.

Figure 1B:
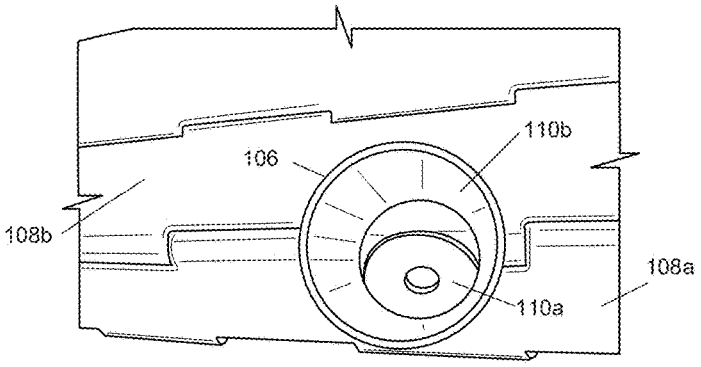
FIG. 1B illustrates one embodiment of a conveyor belt in accordance with the invention showing the demoulding zone.

View [FIG. 1A] shows a location upstream of the demoulding zone, whereas view [FIG. 1B] shows the demoulding zone, where the chain plate 108*a* secured to the base of the mould 106 in question pivots independently of the rest of the mould 106, thereby causing the pellet to become detached. This view therefore makes it possible to clearly understand how the demoulding occurs and also makes it possible to clearly visualize the two adjoining chain plates 108*a* and 108*b* and the articulation between the two chain plates 108*a* and 108*b* in the demoulding zone.

Figure 2:
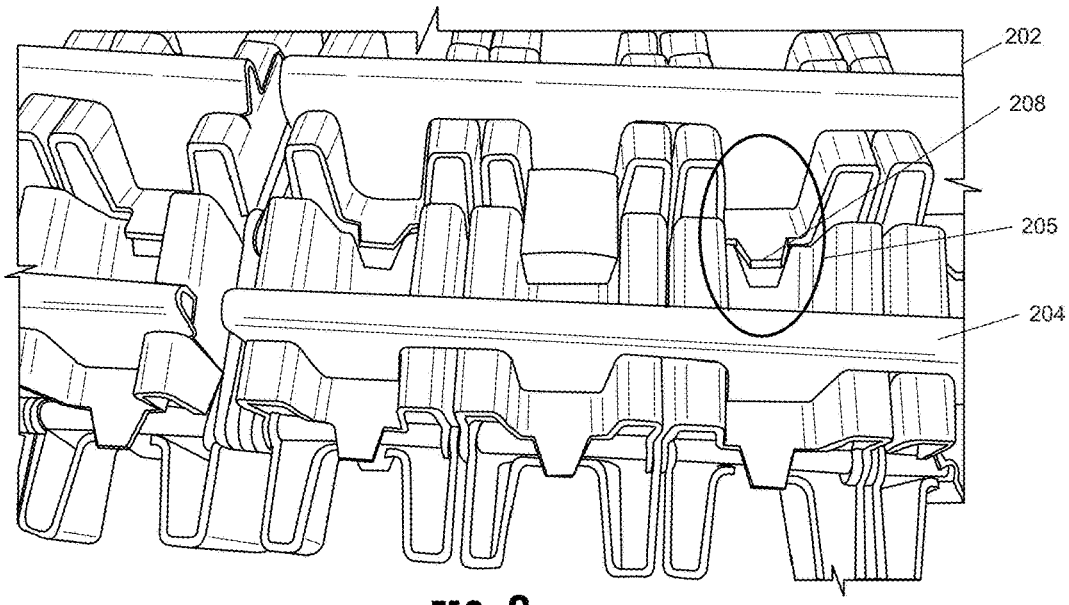
FIG. 2 illustrates another embodiment of a conveyor belt in accordance with the present invention.
Figure 3:
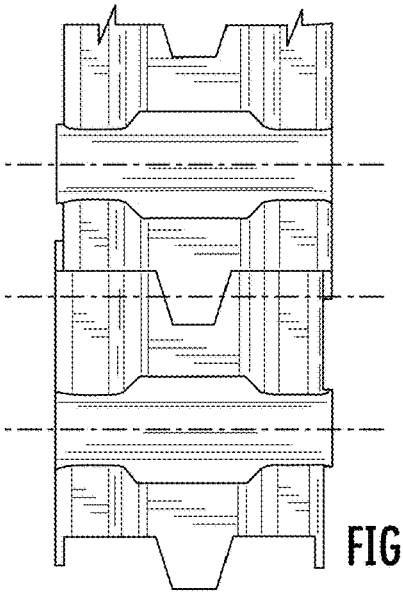
FIG. 3 illustrates another embodiment of a conveyor belt in accordance with the present invention.
Figure 4:
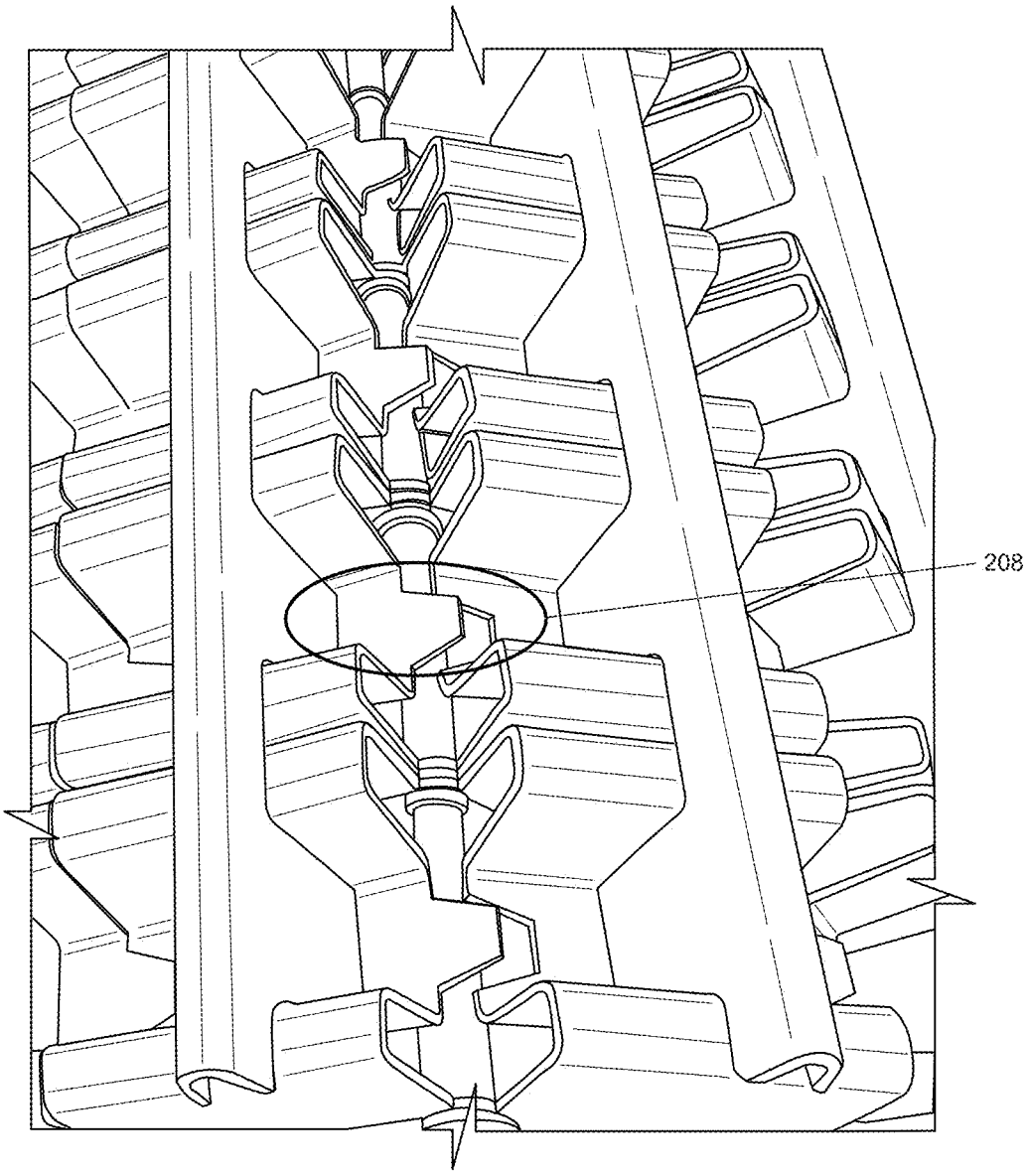
FIG. 4 illustrates another embodiment of a conveyor belt in accordance with the present invention.

By contrast, appended [FIG. 2], [FIG. 3] and [FIG. 4] illustrate another embodiment of a conveyor belt 202 in accordance with the invention, a conveyor 204 that is described in this technical field as a "bucket" conveyor, a conveyor with a regular arrangement of moulds or recesses or bucket 206 that are able to receive a portion of product, in liquid or pasty form, to be deep-frozen, wherein each pellet is automatically demoulded by ejection, the ejection being effected by a given element of the structure of the conveyor belt 202.

Moreover, for this embodiment, this ejection is in this case achieved by the combination of the following means:

- the specific shape of the base of the bucket or mould, which is equipped with a tongue shape 208 (surrounded by an oblong circle in FIGS. 2 and 4);
- applying a rotation of the conveyor 204, and therefore of each bucket 206 in the demoulding zone, which, in this case, also allows opposing forces to be applied to the walls 110*b* of the bucket 206, thereby detaching the pellet (the tongue pivots after a first part of the ice cube has advanced).

Without being bound in any way by the following explanation, the forces involved may perhaps be likened, to a certain extent, to the phenomena occurring when a person manually "flexes" a plastic ice cube tray in order to demould these ice cubes.

As will be clearly apparent to those skilled in the art, the moulds may of course have a cylindrical or parallelepipedal shape, but may also have any other more complex geometric shape according to the product in question.

The advantage of using a stainless-steel conveyor belt is that the control temperature may be very significantly lower than for a belt made of polymer material. The other benefit of stainless steel is that this alloy exhibits the distinctive feature of being non-stick to a certain extent. Specifically, studies have shown that food products do not stick to stainless steel at temperatures below −100° C. This distinctive feature is quite similar to the lotus effect.

For metering the product into the small moulds, use will be made of a commercially available metering device upstream of the inlet zone in the tunnel; metering devices are known to those skilled in the art in this field and will therefore not be described in more detail here but just a brief description of the exemplary metering device used herein. The metering device used herein may be an existing fixed orifice device such as orifice tubes and piston valves, or an existing expansion valve (TXV). The orifice tubes and piston valves don't modulate and have a fixed opening size to control the amount of liquid or pasty released to the moulds on the conveyer belt. The TXV is used to control the amount of liquid or pasty released to the moulds on the conveyer belt.

The Applicant carried out tests in one embodiment of the invention in accordance with the embodiment in FIG. 2, characterized as follows:

- tests were carried out in a 3 m long and 1.2 m wide experimental tunnel;
- with use of various products, ranging from highly liquid to thicker products: highly liquid couscous stock to very thick bechamel sauce;
- 20 capsules were processed across the width, 20 g per capsule;
- 5 to 6 minutes of passage time inside the tunnel, which allowed approximately 250 kg/h of product to be processed (this suggests 1 tonne/h could be achieved for a 12 m long production tunnel).

The results observed in such conditions show a great ease of demoulding.

The present invention thus relates to equipment for manufacturing pellets of liquid or pasty products, comprising a tunnel and comprising a conveyor belt capable of transporting the product to be processed in the equipment along a processing path that passes through the various zones of the equipment, and implementing the following measures:

- the equipment comprises an upstream zone situated upstream of the product inlet in the tunnel, the upstream zone comprising a device for metering and depositing the product to be processed into moulds;
- the equipment comprises a pellet demoulding zone situated at the outlet of the tunnel or immediately downstream of the outlet of the tunnel, the demoulding zone operating in a rotation zone of the conveyor;
- the conveyor belt is equipped with unitary moulds, or else unitary moulds are formed in the structure of the conveyor belt;
- the structure of the belt allowing each pellet to be automatically demoulded by ejection, the ejection being effected by a given element of the structure of the conveyor belt on account of opposing forces being applied to the walls of the mould in the demoulding zone.

According to one of the embodiments of the invention:

- the conveyor belt is made of stainless steel, is of the type known as a "chain-plate" conveyor belt, and is equipped with moulds that are positioned at the surface of the conveyor and are able to receive a portion of liquid or pasty product to be deep-frozen;
- the moulds are secured to the conveyor and are made up of two parts, each mould being positioned at the join between two chain plates of the conveyor: one element forming the base of the mould being secured to one chain plate, whereas the other part of the mould, which forms the sides of the mould, is secured to the chain plate immediately adjoining the first chain plate;
- the equipment comprises a pellet demoulding zone situated at the outlet of the tunnel or immediately downstream of the outlet of the tunnel, the demoulding zone operating in a rotation zone of the conveyor, wherein the base of each mould pivots inside the mould on account of the articulation between the two adjacent chain plates in question for a given mould, which allows the pellets to be detached both from the mould and from the base.

According to another of the embodiments of the invention:

the conveyor belt is made of stainless steel, is of the type known as a "bucket" conveyor belt, the buckets forming moulds that are able to receive a portion of liquid or pasty product to be deep-frozen;

the equipment comprises a pellet demoulding zone situated at the outlet of the tunnel or immediately downstream of the outlet of the tunnel, the demoulding zone operating in a rotation zone of the conveyor, wherein the demoulding is effected automatically by ejection, the ejection being in this case achieved by the combination of the following means:

the specific shape of the base of the bucket, which features a component in the form of a tongue;

applying a rotation of the conveyor in the demoulding zone, which allows said opposing forces to be applied to the walls of the bucket, which detaches the pellet, the tongue pivoting in the period of time after a first portion of the pellet has advanced into the demoulding zone.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

Although the subject matter described herein may be described in the context of illustrative implementations to process one or more computing application features/operations for a computing application having user-interactive components the subject matter is not limited to these particular embodiments. Rather, the techniques described herein may be applied to any suitable type of user-interactive component execution management methods, systems, platforms, and/or apparatus.

It will be understood that many additional changes in the details, materials, steps, and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

The invention claimed is:

1. Equipment for manufacturing deep-frozen pellets of liquid or pasty products, comprising a cryogenic tunnel; and a conveyor belt capable of transporting the product to be processed in the equipment along a processing path that passes through various zones of the equipment, and the equipment implementing the following measures:

a. the equipment comprises an upstream zone situated upstream of a product inlet in the tunnel, the upstream zone comprising a device configured to meter and deposit the product to be processed into moulds formed in the structure of the conveyor belt;

b. the equipment comprises a pellet demoulding zone situated at the outlet of the tunnel or immediately downstream of the outlet of the tunnel; and wherein the demoulding zone operates in a rotation zone of the conveyor, and the structure of the belt allows each pellet to be automatically demoulded by ejection, the ejection being effected by a given element of the structure of the conveyor belt on account of opposing forces being applied to the walls of the mould in the demoulding zone.

2. The equipment of claim 1, wherein:

the conveyor belt is made of stainless steel, is of the type known as a "chain-plate" conveyor belt, and is equipped with moulds that are positioned at the surface of the conveyor and are able to receive a portion of liquid or pasty product to be deep-frozen;

the moulds are secured to the conveyor and are made up of two parts, each mould being positioned at the join between two chain plates of the conveyor: one element forming the base of the mould being secured to one chain plate, whereas the other part of the mould, which forms the sides of the mould, is secured to the chain plate immediately adjoining the first chain plate; and the base of each mould pivots inside the mould on account of the articulation between the two adjacent chain plates in question for a given mould, which allows the pellets to be detached both from the mould and from the base.

3. The equipment of claim 1, wherein the conveyor belt, made of stainless steel, is of the type known as a bucket conveyor belt, the buckets forming moulds that are able to receive a portion of liquid or pasty product to be deep-frozen; and said ejection is in this case achieved by the combination of the following means:

1. the specific shape of the base of the bucket features a component in the form of a tongue;
2. a rotation of the conveyor in the demoulding zone is applied, which allows said opposing forces to be applied to the walls of the bucket, which detaches the pellet, the tongue pivoting in the period of time after a first portion of the pellet has advanced into the demoulding zone.

* * * * *